US008430149B2

(12) United States Patent
Gilbert

(10) Patent No.: US 8,430,149 B2
(45) Date of Patent: Apr. 30, 2013

(54) FOLDING CHURCH TRUCK SURROUND

(76) Inventor: Roy O. Gilbert, Gardner, MA (US)

( * ) Notice: Subject to any disclaimer, the term of this patent is extended or adjusted under 35 U.S.C. 154(b) by 170 days.

(21) Appl. No.: 12/980,670

(22) Filed: Dec. 29, 2010

(65) Prior Publication Data

US 2012/0168097 A1 Jul. 5, 2012

(51) Int. Cl.
*A47G 5/00* (2006.01)
*A61G 17/00* (2006.01)

(52) U.S. Cl.
USPC ..... 160/135; 160/351; 27/1

(58) Field of Classification Search ..... 160/135, 160/218, 220, 229.1, 351; 211/85.6; 248/166, 248/436; 52/71
See application file for complete search history.

(56) References Cited

U.S. PATENT DOCUMENTS

| | | | | |
|---|---|---|---|---|
| 1,954,402 | A * | 4/1934 | Culp et al. | 160/230 |
| 3,498,587 | A * | 3/1970 | Friedberg | 52/71 |
| 5,379,786 | A * | 1/1995 | Lynam | 135/87 |
| 6,123,321 | A * | 9/2000 | Miller | 256/25 |
| 6,574,837 | B2 * | 6/2003 | Jantschek | 16/371 |
| 2009/0026160 | A1 * | 1/2009 | Wright et al. | 211/85.16 |

* cited by examiner

*Primary Examiner* — Katherine Mitchell
*Assistant Examiner* — Jeremy Ramsey
(74) *Attorney, Agent, or Firm* — Lambert & Associates; Gary E. Lambert; David J. Connaughton, Jr.

(57) ABSTRACT

A folding church truck surround having a center panel, a pair of front panels, a pair of corner panels and a pair of side panels, wherein the front panels are hingedly attached to the center panel, and wherein the side panels are hingedly attached to the pair of corner panels extending from the front panels, to allow the surround to maintain both an open and closed position through the folding and unfolding of the various panels.

18 Claims, 5 Drawing Sheets

FOLDING CHURCH TRUCK SURROUND

BACKGROUND OF THE INVENTION

1. Field of the Invention

The instant invention relates generally to chapel furniture, and more particularly to a folding church truck surround that is disposed to be preferably arranged around a church truck and casket by the folding and unfolding of various panels.

2. Description of the Related Prior Art

Caskets are used for the interment of the bodies of deceased persons. Prior to interment, the body of the deceased is typically displayed in a casket for the benefit of loved ones at a funeral home. The use of a bier to support the casket at the funeral home is known in the art. Typically, the lifting of the displayed casket from the church truck to the bier then is flanked by floral arrangements and personal effects of the deceased. A church truck surround should have a high quality finished furniture appearance. Further, the surround could have a display top cover for displaying the personal effects of the deceased in a tasteful and meaningful manner in the event of cremation.

SUMMARY OF THE INVENTION

The instant invention, as illustrated herein, is clearly not anticipated, rendered obvious or even present in any of the prior art mechanisms, either alone or in any combination thereof.

A primary object of the instant invention is to provide a folding church truck surround that is disposed to be arranged around a casket through the folding and unfolding of various panels.

Another object of the instant invention is to provide a folding church truck surround that includes a plurality of interchangeable graphic panels removeably attached to a center panel, a pair of front panels, a pair of corner panels, and pair of side panels.

Another object of the instant invention is to provide a folding church truck surround wherein a pair of front panels are disposed to be hingedly attached to the center panel, preferably at a ninety degree angle with respect to the center panel and disposed for inward rotation to assume both an open and closed position.

Another object of the instant invention is to provide a folding church truck surround wherein a pair of side panels are disposed to be hingedly attached to pair of corner panels extending outwardly from the front panels preferably at a ninety angle with respect to the front panels, and disposed for inward rotation to assume both an open and closed position.

There has thus been outlined, rather broadly, the more important features of a church truck surround in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

FIG. 4B in particular shows a display top cover 100 attached to the top of the instant invention when in a closed position.

DETAILED DESCRIPTION OF THE PREFERRED EMBODIMENT

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Figure 1:
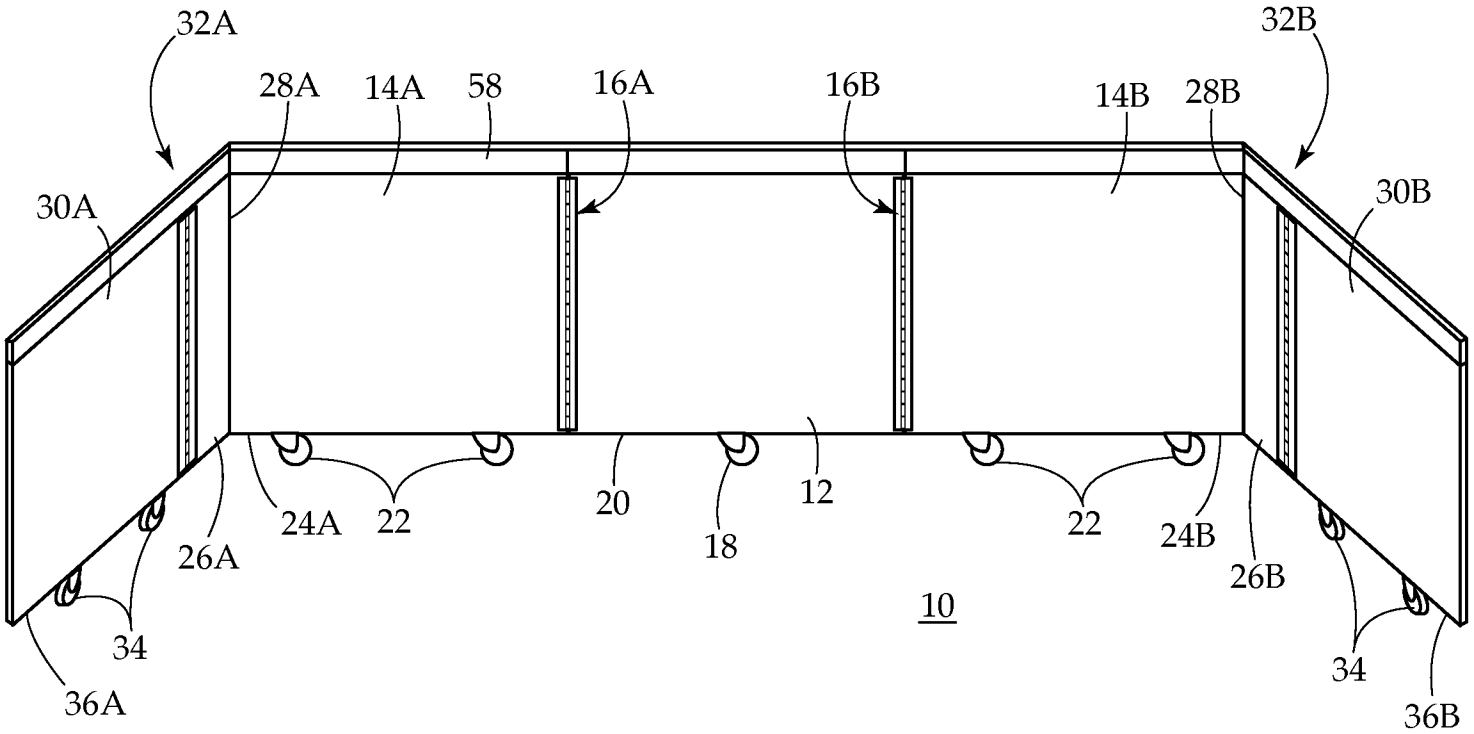
FIG. 1 illustrates a perspective view of one embodiment of the instant invention, wherein the instant invention is shown in an "open" position.

FIG. 1 illustrates a diagrammatic perspective view of the instant invention 10, wherein a center panel 12 is in communication with a pair of front panels 14A and 14B, wherein each individual front panel 14A and 14B is attached to an opposing portion 16A and 16B of the center panel 12 with respect to the other individual front panel 14A and 14B. In one preferred embodiment, the center panel 12 includes at least one wheel 18 substantially located on a bottom portion 20 of the center panel 12. Furthermore, each individual front panel 14A and 14B of the pair of front panels 14A and 14B is in communication with the center panel through an attachment means 22, wherein each front panel 14A and 14B is preferably hingedly attached to the center panel 12 to allow for inward rotation of each front panel 14A and 14B with respect to the center panel 12. In one embodiment, each individual front panel 14A and 14B includes a pair of wheels 22 substantially located on a bottom portion 24A and 24B of each front panel 14A and 14B.

Each individual front panel 14A and 14B further includes a corresponding corner panel 26A and 26B extending outwardly preferably at a ninety angle with respect to the corresponding front panel 14A and 14B from the free end 28A and 28B of each corresponding front panel 14A and 14B. The instant invention 10 further comprises a pair of side panels 30A and 30B, wherein each individual side panel 30A and 30B is hingedly attached to a free end 32A and 32B of each corresponding corner panel 26A and 26B, to allow for inward rotation of each side panel 30A and 30B with respect to each corresponding front panel 14A and 14B and corner panel 26A and 26B. In one preferred embodiment, each side panel 30A and 30B includes a pair of wheels 34 substantially located on a bottom portion 36A and 36B of each side panel 30A and 30B.

Figure 2:
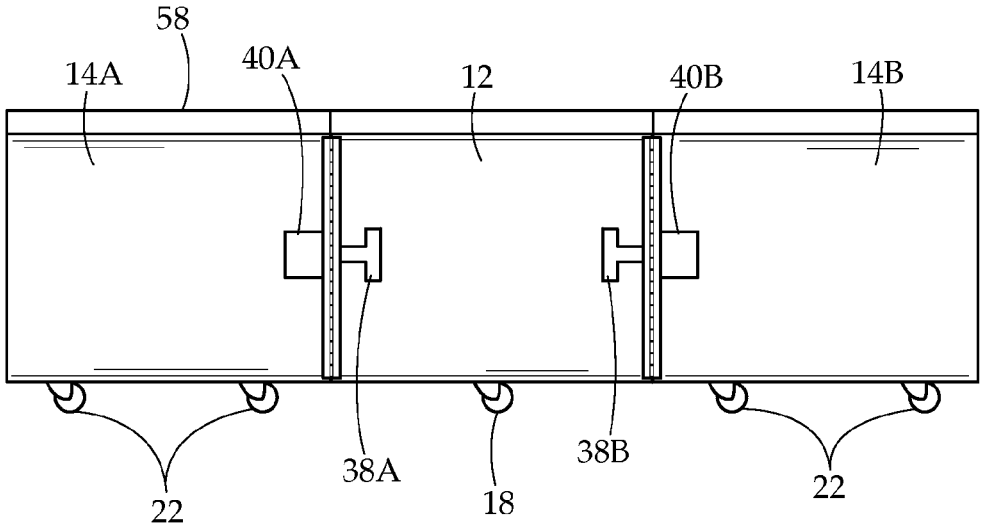
FIG. 2 illustrates a pair of locking mechanisms substantially located on a center panel of the instant invention, wherein each locking mechanism is receivable in a corresponding recess.

FIG. 2 illustrates a diagrammatic perspective view of the center panel 12 and the corresponding front panels 14A and 14B hingedly attached to opposing sides 16A and 16B of the center panel 12. In this embodiment, the center panel includes a pair of opposing locking mechanism 38A and 38B, wherein each individual locking mechanism 38A and 38B is disposed to be received in a corresponding recess 40A and 40B substantially located on each individual front panel 14A and 14B. In one embodiment, each locking mechanism 38A and 38B is disposed to maintain the center panel 12 in uniform parallel alignment with respect to each front panel 14A and 14B.

Figure 3A:
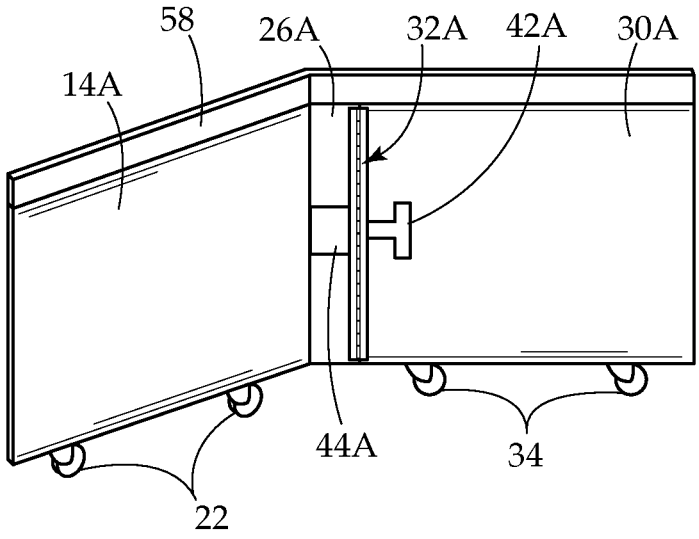
FIGS. 3A-3B illustrate locking mechanisms substantially located on a pair of side panels of the instant invention, wherein each locking mechanism is disposed to secure in place each side panel to a corresponding corner panel extending from each front panel.
Figure 3B:
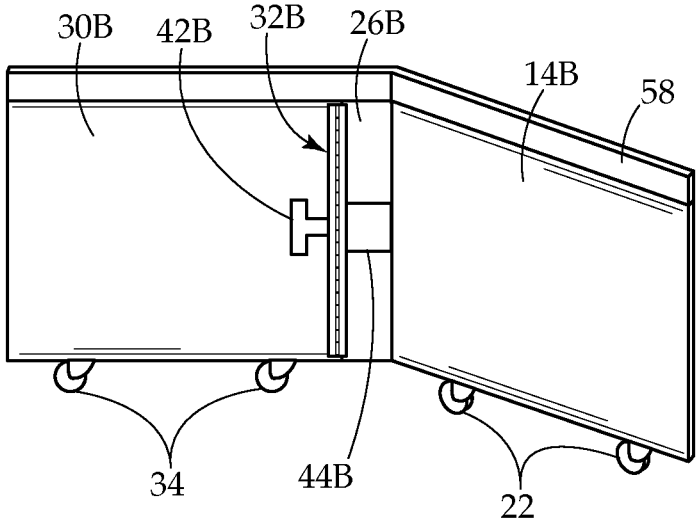

FIGS. 3A and 3B illustrate the pair of side panels 30A and 30B attached to the free end 32A and 32B of each corresponding corner panel 26A and 26B extending outwardly from the front panels 14A and 14B. In this embodiment, each individual side panel 30A and 30B includes a locking mechanism 42A and 42B, wherein each individual locking mechanism 42A and 42B is disposed to be received in a corresponding recess 44A and 44B substantially located on each individual corner panel 26A and 26B. In one embodiment, each locking mechanism 42A and 42B is disposed to maintain each side panel 30A and 30B in a substantially ninety degree angle alignment with respect to each corresponding front panel 14A and 14B.

Figure 4A:
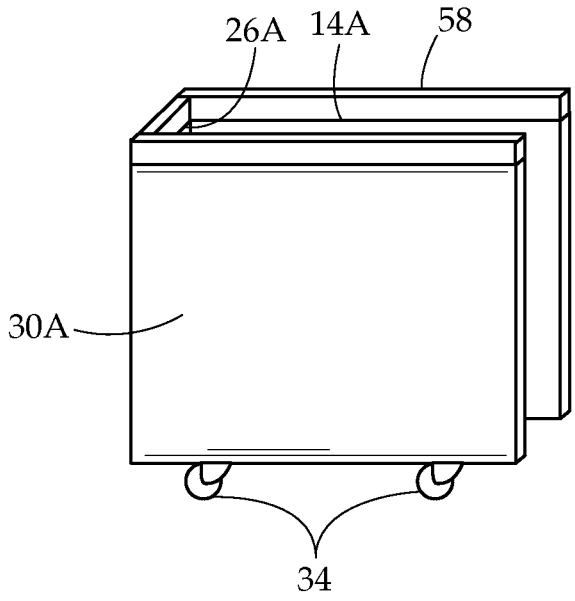
FIGS. 4A-4B illustrates the pair of side panels of the instant invention in a "closed" position with respect to a pair of front panels attached to the side panels through each corner panel.
Figure 4B:
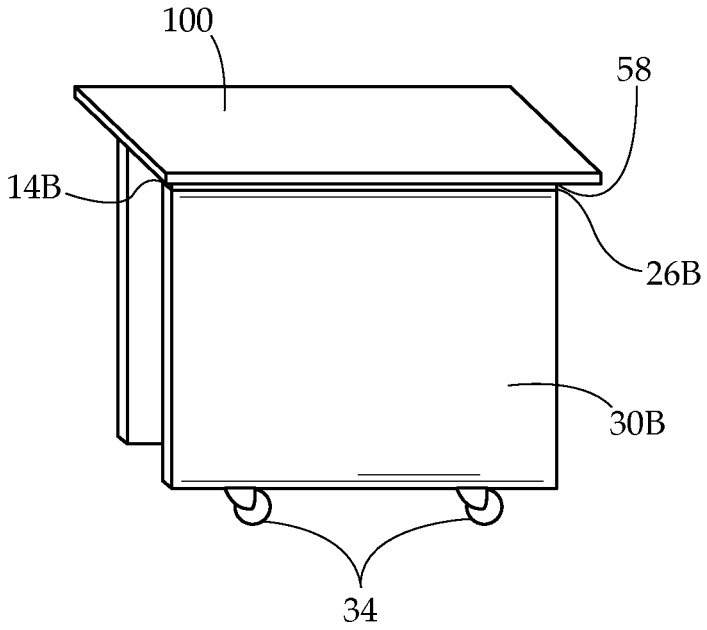

FIGS. 4A and 4B illustrate a diagrammatic perspective view of the pair of side panels 30A and 30B in a closed position with respect to each corresponding front panel 14A and 14B wherein each side panel 30A and 30B is in a substantially parallel alignment with respect to each corresponding front panel 14A and 14B.

Figure 5:
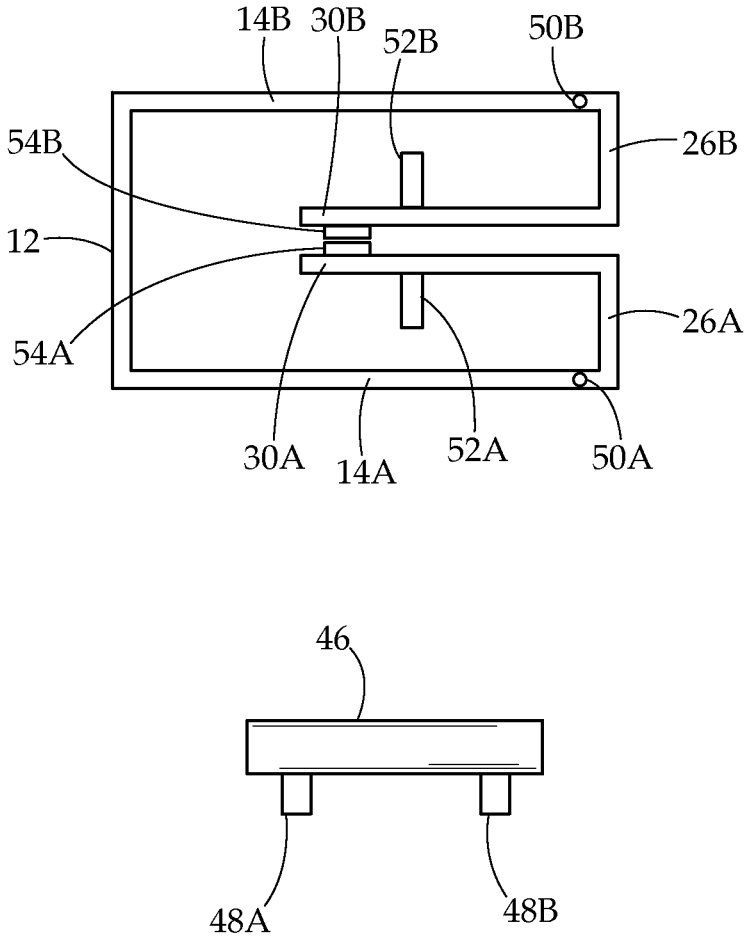
FIG. 5 illustrates the instant invention in a closed position during non-usage and a top locking mechanism of the instant invention between the pair of front panels to place the instant invention in a "closed" position.

FIG. 5 illustrates a diagrammatic perspective view of the instant invention 10 in a closed position, wherein the pair of side panels 30A and 30B are in a substantially parallel alignment with each of the corresponding front panels 14A and 14B, and the pair of corner panels 26A and 26B are in a substantially parallel alignment with the center panel 12. Furthermore, the pair of front panels 14A and 14B, along with the pair of side panels 30A and 30B is in a substantially perpendicular alignment with respect to the center panel 12 and the pair of corner panels 26A and 26B. Additionally, in one embodiment, the instant invention 10 further includes a locking tab 46, wherein the locking tab 46 includes a pair of knobs 48A and 48B extending downwardly from the locking tab 44 and disposed to be received in a pair of cavities 50A and 50B located in the front panels 14A and 14B to maintain the instant invention 10 in a closed position. In yet another embodiment, each side panel 30A and 30B further includes a rotatable bar 52A and 52B to limit the inward rotation of each side panel 30A and 30B with respect to each corresponding front panel 14A and 14B. Additionally, each side panel 30A and 30B further includes a pair of stop tabs 54A and 54B and stop knobs 56A and 56B to prevent the side panels 30A and 30B from contacting each other and to ensure a proper alignment of the various panels when the instant invention assumes a closed position. In yet another embodiment, a top rail 58 is disposed to extend along a top portion 60 of each side panel 30A and 30B, each corner panel 26A and 26B, each front panel 14A and 14B, and the center panel 12, wherein the top rail is disposed to provide support for a casket.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A folding church truck surround comprising:

a center panel;

a pair of front panels, wherein each individual front panel is hingedly attached to an opposing portion of the center panel with respect to the other individual front panel; and a pair of corner panels, wherein each individual corner panel is disposed to extend outwardly from a free end of each individual front panel, each individual corner panel being permanently attached to the free end of each individual front panel at a ninety degree angle;

a pair of side panels, wherein each individual side panel is hingedly attached to a free end of each corresponding individual corner panel;

the folding church truck surround having an open position and a closed position;

wherein the open position having the pair of front panels positioned at a 180 degree angle with respect to the center panel;

wherein the open position having each of the side panels positioned at a 180 degree angle with respect to each of the corresponding individual corner panels;

wherein the closed position having each of the pair of front panels positioned at a ninety degree angle with respect to the center panel; and wherein the closed position having each of the side panels positioned at a ninety degree angle with respect to the first portion of each of the pair of corner panels.

2. The folding church truck surround of claim 1, wherein the center panel includes at least one wheel substantially located on a bottom portion of the center panel.

3. The folding church truck surround of claim 1, wherein each individual front panel is disposed for inward rotation with respect to the center panel.

4. The folding church truck surround of claim 1, wherein each individual front panel includes a pair of wheels substantially located on a bottom portion of each individual front panel.

5. The folding church truck surround of claim 1, wherein each individual side panel is disposed for inward rotation with respect to each corresponding individual front panel.

6. The folding church truck surround of claim 1, wherein each individual side panel includes a pair of wheels substantially located on a bottom portion of each individual side panel.

7. The folding church truck surround of claim 1, wherein the center panel includes a pair of opposing locking mechanisms.

8. The folding church truck surround of claim 7, wherein each individual locking mechanism located in the center panel is disposed to be received in a corresponding recess located on each individual front panel.

9. The folding church truck surround of claim 7, wherein each individual locking mechanism is disposed to maintain the center panel in a uniform parallel alignment with respect to each individual front panel.

10. The folding church truck surround of claim 1, wherein each individual side panel includes a locking mechanism.

11. The folding church truck surround of claim 10, wherein each individual locking mechanism located in each individual side panel is disposed to be received in a corresponding recess located on each individual corner panel.

12. The folding church truck surround of claim 10, wherein each individual locking mechanism is disposed to maintain each individual side panel in a substantially ninety degree angle alignment with respect to each corresponding front panel.

13. The folding church truck surround of claim 1, wherein each individual side panel is disposed to maintain a substantially parallel alignment with respect to each individual corresponding front panel in the closed position.

14. The folding church truck surround of claim 1, wherein each individual front panel is disposed to maintain a substantially perpendicular alignment with respect to the center panel and the pair of corner panels in the closed position.

15. The folding church truck surround of claim 14, wherein the surround further includes a locking tab having a pair of knobs and disposed to be received in a pair of cavities located in the front panels to maintain the surround in the closed position.

16. The folding church truck surround of claim 14, wherein each side panel further includes a rotatable bar to limit the inward rotation of each side panel with respect to the corresponding front panel.

17. The folding church truck surround of claim 14, wherein each side panel further includes a stop tab to prevent the side panels from contacting each other and to ensure a proper alignment of the surround in a closed position.

18. The folding church truck surround of claim 1 further comprising a display top cover removably attached to a top of the folding church truck surround when in the closed position.

* * * * *